US006910917B2

(12) United States Patent
Chen

(10) Patent No.: US 6,910,917 B2
(45) Date of Patent: Jun. 28, 2005

(54) ELECTRIC CONNECTOR COMBINATION

(75) Inventor: Wan-Tien Chen, Taipei (TW)

(73) Assignee: Egbon Electronics Ltd., Taipei (TW)

( * ) Notice: Subject to any disclaimer, the term of this patent is extended or adjusted under 35 U.S.C. 154(b) by 26 days.

(21) Appl. No.: 10/724,602

(22) Filed: Dec. 2, 2003

(65) Prior Publication Data

US 2005/0009409 A1 Jan. 13, 2005

(30) Foreign Application Priority Data

Jul. 11, 2003 (TW) ..... 92212804 U

(51) Int. Cl.[7] ..... H01R 13/60
(52) U.S. Cl. ..... 439/541.5; 439/620; 439/490
(58) Field of Search ..... 439/541.5, 490, 439/620, 676

(56) References Cited

U.S. PATENT DOCUMENTS 6,474,999 B1 * 11/2002 Givens et al. ..... 439/76.1
6,540,564 B1 * 4/2003 Ko ..... 439/676
6,702,618 B1 * 3/2004 Hyland et al. ..... 439/620
6,749,467 B2 * 6/2004 Korsunsky et al. ..... 439/676
2002/0146940 A1 * 10/2002 Colantuono et al. ..... 439/676
2003/0087559 A1 * 5/2003 Korsunsky et al. ..... 439/676

* cited by examiner

*Primary Examiner*—Phuong Dinh
(74) *Attorney, Agent, or Firm*—Dennison, Schultz, Dougherty & MacDonald

(57) ABSTRACT

An electric connector combination, the combination comprises an insulation main body, a first electric connector, a second electric connector, two signal displays, a rear lid and an obscuring housing; wherein the upper portion of the insulation main body can be used as a pin seat of the first electric connector, and the lower portion of the insulation main body can be used as a fixing seat of the second electric connector. In this mode, composing elements can be reduced and further lower the cost of mould making.

6 Claims, 6 Drawing Sheets

ELECTRIC CONNECTOR COMBINATION

BACKGROUND OF THE INVENTION

1. Field of the Invention

The present invention is related to an electric connector combination, and especially to an electric connector combination composed of an RJ45 and a USB electric connector assembled with each other in a stacking mode. The RJ45 electric connector has a conversion device and two signal displays; an electronic element is provided on a circuit board of the conversion device. The electric connector combination comprises an insulation main body, the RJ45 electric connector (first electric connector), the USB electric connector (second electric connector), the two signal displays, a rear lid and an obscuring housing; wherein the upper portion of the insulation main body can be used as a pin seat for the first electric connector, the lower portion of the insulation main body can be used as a fixing seat of the second electric connector. This can reduce the composing elements, and can lower the cost of mould making.

2. Description of the Prior Art

Generally, a conventional electric connector combination is assembled by stacking a plurality of electric connectors to reduce the space occupancy of the electric connectors on a main board. Therefore, the structure of conventional stacked electrical connector assembly mainly comprises an insulation housing, a first electric connector, a second electric connector, an insulation plate, a light-emitting device and an obscuring housing. The first electric connector has an insulation main body for providing a modular jack, which further has two seats and a connecting portion for providing with a conversion device.

Because the insulation housing, the insulation main body, the two seats, the connecting portion and the insulation plate are all housings formed by injection molding of plastic, and the second electric connector also has a housing formed by injection molding of plastic, the composing elements are more complicated. This not only renders assembling uneasy, but also causes higher cost of production due to the larger amount of mould to be made.

In view of this, the present invention was developed to get rid of the defects.

SUMMARY OF THE INVENTION

The main object of the present invention is to provide an electric connector combination. It directly uses an insulation main body concurrently as a pin seat for the first electric connector and a fixing seat of the second electric connector. This can reduce composing elements, and can lower the cost of mould making for the housings formed by injection molding of plastic.

To achieve the above stated object, an electric connector combination provided for the present invention mainly comprises: an insulation main body, a first electric connector, a second electric connector, two signal displays, a rear lid and an obscuring housing.

The insulation main body has two lateral walls and a top wall. The interior space between the two lateral walls is partitioned into a first receiving space and a second receiving space with an L-shaped partition. The partition has a step portion with a U-shaped cross-section on an end thereof, wherein the step portion has a plurality of mutually spaced receiving slits forming the shape of a fence. A long rib member is provided between the partition and the top wall.

The long rib member has therein a plurality of slits with trapezoidal walls. The long rib member has positioning notches on the two lateral ends thereof, and a passage extending rearwards is provided on each of the junctions between the top wall and the two lateral walls.

The first electric connector is composed of circuit board, a plurality of electric conductive pins and a modular jack. The circuit board has an electronic element thereon. The electric conductive pins are provided by welding on the front end of the circuit board and at one side of the electronic element. The modular jack is provided by welding on the rear end of the circuit board and at the other side of the electronic element. The circuit board is inserted in the two positioning notches of the long rib member of the insulation main body, while the tailing ends of the electric conductive pins are limited in the slits with trapezoidal walls. The electric conductive pins have bends that are embedded in the receiving slits on the partition of the insulation main body.

The second electric connector has two USB ports able to be embedded in the second receiving space of the insulation main body.

The two signal displays are light-emitting diodes each having a light-emitting portion. These light-emitting portions can be embedded in the passages of the insulation main body, and are extended to have two L-shaped pins each.

The rear lid has positioning insertion-holes and insertion grooves on the two lateral sides thereof for insertion of the L-shaped pins of the signal displays. The rear lid can be fixed on the rear of the insulation main body.

The obscuring housing is integrally formed of electric conductive material for slipping over and enveloping the insulation main body.

Thereby, the insulation main body can be simultaneously used as a pin seat for the first electric connector and a fixing seat of the second electric connector. This can reduce composing elements, and can lower the cost of mould making.

The present invention will be apparent after reading the detailed description of the preferred embodiment thereof in reference to the accompanying drawings.

DETAILED DESCRIPTION OF THE PREFERRED EMBODIMENT

Figure 1:
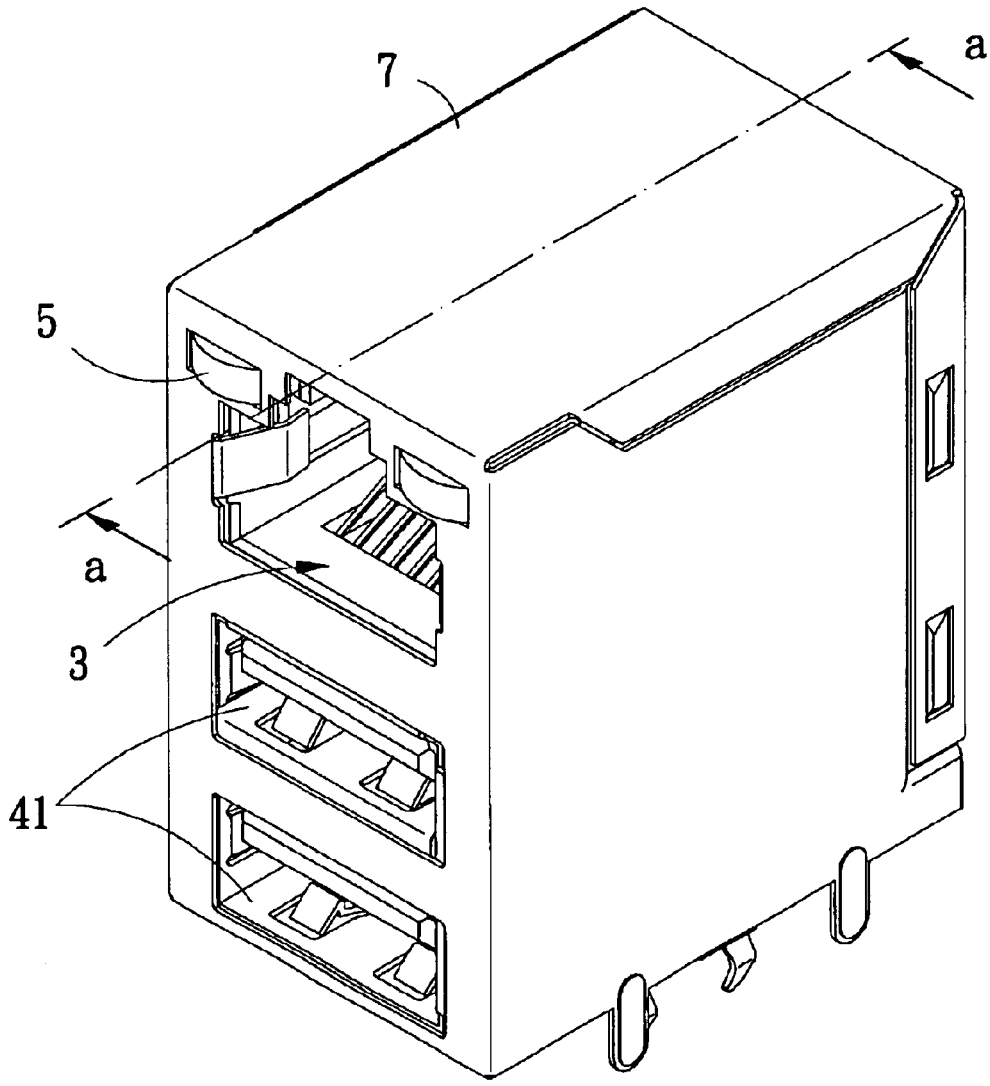
FIG. 1 is a perspective view showing the appearance of an embodiment of the present invention after assembling of all its elements.
Figure 2:
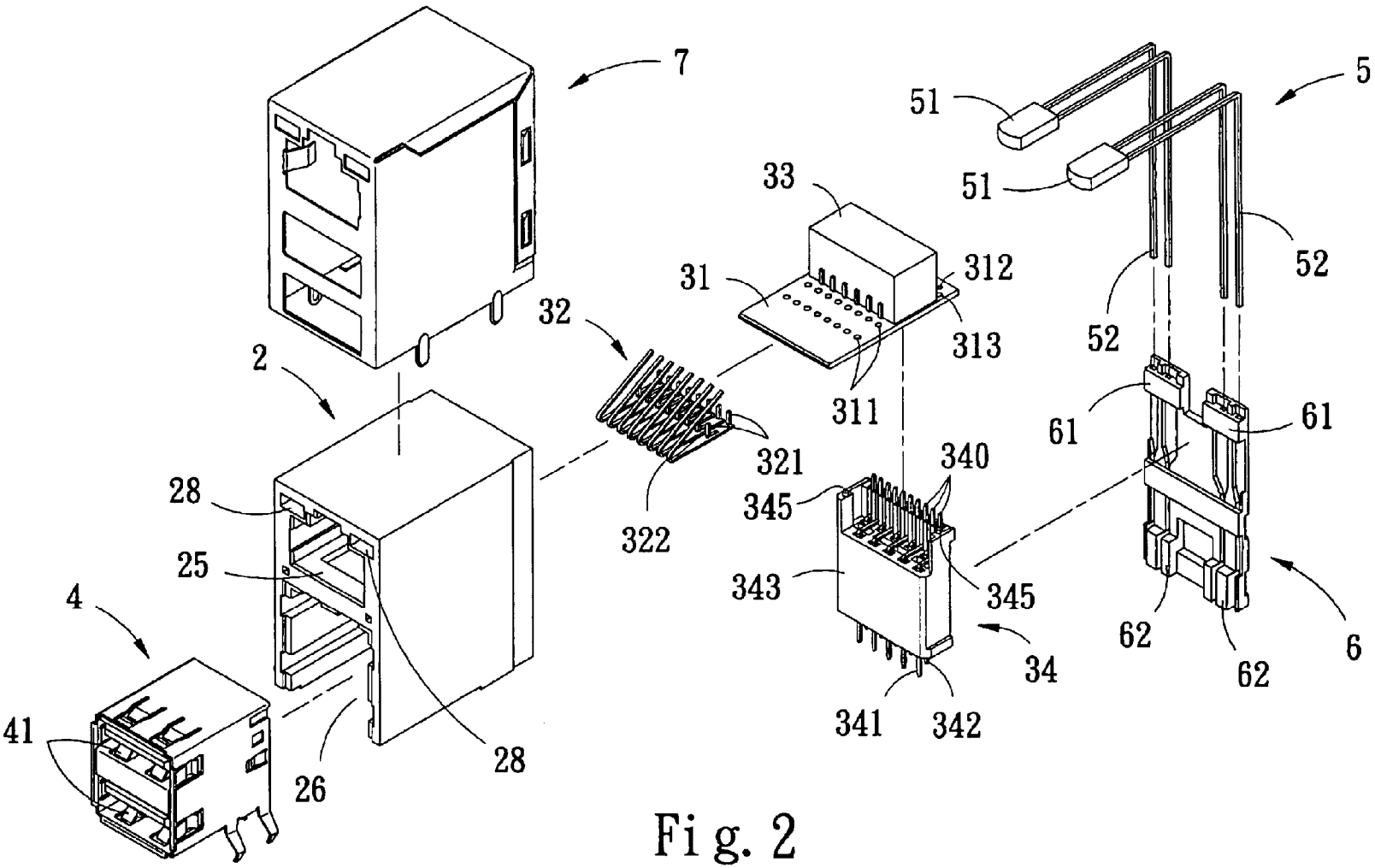
FIG. 2 is an exploded perspective view of the embodiment of the present invention.
Figure 3:
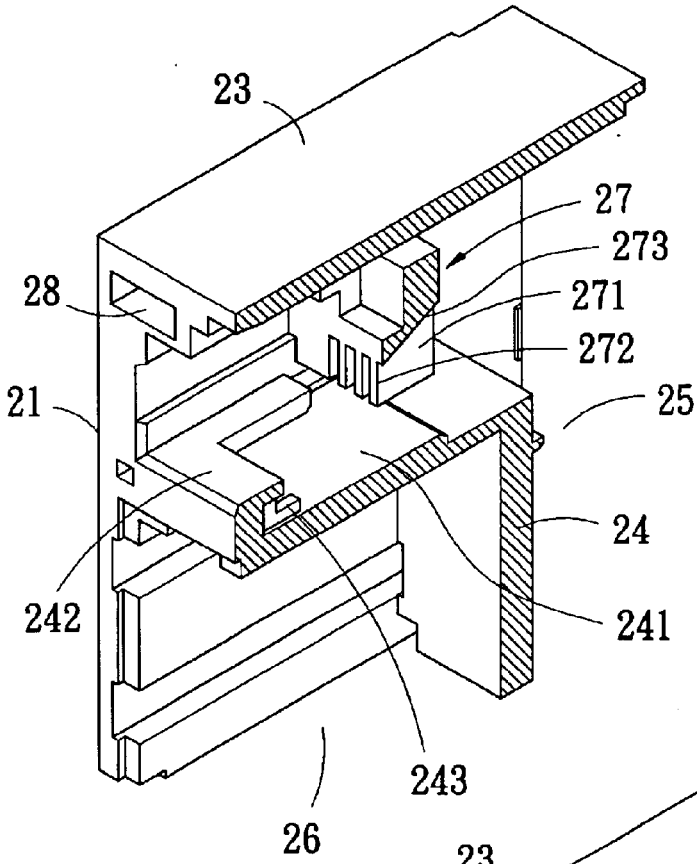
FIG. 3 is a sectional perspective view of an insulation main body of the present invention.
Figure 4:
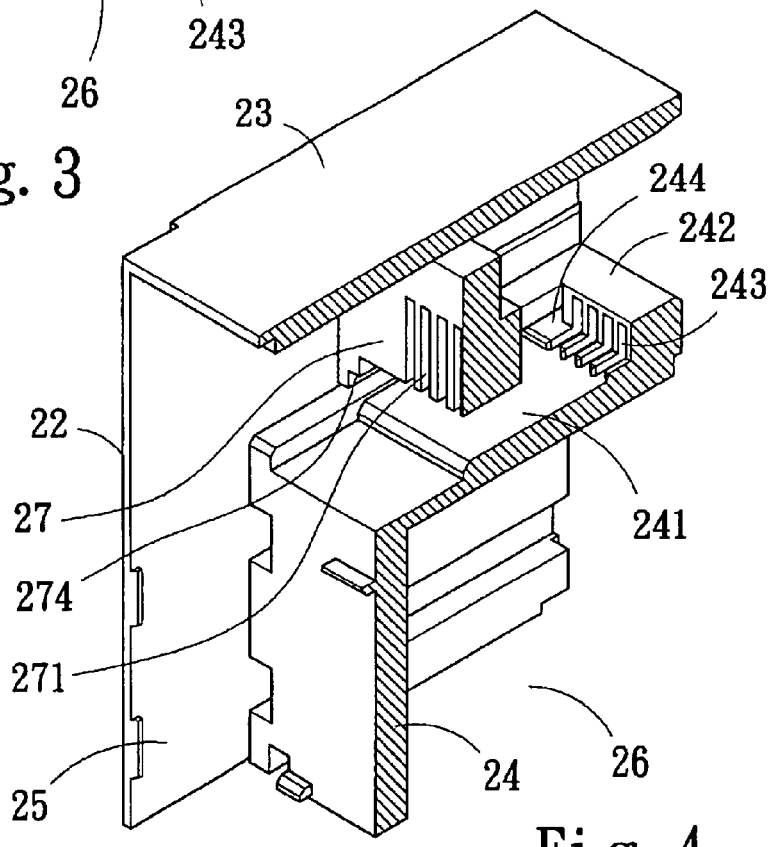
FIG. 4 is a sectional perspective view of the insulation main body of the present invention shown in another direction of viewing.

Referring to FIGS. 1–7 showing an embodiment of an electric connector combination of the present invention, the connector comprises: an insulation main body 2, a first electric connector 3, a second electric connector 4, two signal displays 5, a rear lid 6 and an obscuring housing 7.

The insulation main body 2 is integrally formed and has two mutually parallel lateral walls 21, 22 and a top wall 23. An L-shaped partition 24 is provided between and connected with the two lateral walls 21, 22, so that the interior of the insulation main body 2 forms a first receiving space 25 and a second receiving space 26. Hence the upper portion of the insulation main body 2 can be used as a pin seat for the first electric connector 3, while the lower portion of the insulation main body 2 can be used as a fixing seat of the second electric connector 4. The partition 24 has a surface parallel to the top wall 23 of the insulation main body 2, which surface has a step portion 241, and has a step portion 242 with a U-shaped cross-section on an end thereof, wherein the step portion has a plurality of mutually spaced receiving slits 243 forming the shape of a fence. There are two platforms 244 respectively disposed on the two lateral sides of the receiving slits 243. A long rib member 27 is provided between the partition 24 and the top wall 23, it has two ends connecting with the two lateral walls 21, 22. One end of the long rib member 27 has a positioning notch 274, a plurality of slits 271 with trapezoidal walls are provided by cutting between the positioning notch 274 and the other end of the long rib member 27. Shorter edges 272 of the slits 271 are opposite to the receiving slits 243, and a passage 28 extending rearwards is provided on each of the junctions between the top wall 23 and the two lateral walls 21, 22.

The first electric connector 3 (that is an RJ45 electric connector) is composed of a circuit board 31, a plurality of electric conductive pins 32 and a modular jack 34. The circuit board 31 has an electronic element 33 thereon as a conversion device. The electric conductive pins 32 are provided by welding on the front end of the circuit board 31 and at one side of the electronic element 33; the modular jack 34 is provided by welding on the rear end of the circuit board 31 and at the other side of the electronic element 33. While the electric conductive pins 32 and the modular jack 34 can be connected electrically with each other by using the circuit and the electronic element 33 of the circuit board 31.

The circuit board 31 is provided with front pin-holes 311 on the front area thereof, and is provided with rear pin-holes 312 and a pair of fixing holes 313 on the rear area thereof.

The electric conductive pins 32 have pin ends 321 for welding to the front pin-holes 311 of the circuit board 31, and have bends 322 which are bended into sharp angles. If it is desired to increase the strength in durability for insertion and drawing, the front pin-holes 311 and the pin ends 321 can be both in two rows.

The modular jack 34 is comprised of a plurality of long pins 341 and short pins 342 alternately arranged on a carrier 343. The pin ends 340 for welding of the long and short pins 341, 342 can be welded fixedly to the rear pin-holes 312 of the circuit board 31, and a pair of fixing posts 345 on the top surface of the carrier 343 can be fixed on the pair of fixing holes 313 on the circuit board 31.

When the first electric connector 3 is placed in the first receiving space 25 of the insulation main body 2, the tailing ends of the pins 32 are limited in the slits 271 with trapezoidal walls and are abutted against a plurality of bevel edges 273. The bends 322 of the electric conductive pins 32 are embedded in the receiving slits 243. The circuit board 31 is inserted and flatly placed on the platforms 244, and is clamped and framed by the positioning notch 274 on one end of the long rib member 27 and the step portion 242 with a U-shaped cross-section.

The second electric connector 4 is composed of two sets of USB type electric connector units 41 stacking with each other to be received in the second receiving space 26 of the insulation main body 2.

The two signal displays 5 are light-emitting diodes each having a light-emitting portion 51. These light-emitting portions 51 are extended to have L-shaped pins 52 each. The signal displays 5 can be embedded in the passages 28 of the insulation main body 2.

The rear lid 6 has positioning insertion-holes 61 and insertion grooves 62 on the two lateral sides thereof for insertion of L-shaped pins 52 of the signal displays 5 by the positioning insertion-holes 61 and the insertion grooves 62 being fixed on the rear of the insulation main body 2 to prevent the circuit board 31 and the carrier 343 being forcedly back and further to help fix the first electric connector 3.

The obscuring housing 7 is integrally formed of electric conductive material for slipping over and enveloping the insulation main body 2.

Thereby, the electric conductive pins 32 of the first electric connector 3 are received in the receiving slits 243 and the slits 271 with trapezoidal walls respectively of the partition 24 and the long rib member 27, so that the first electric connector 3 can be tightly and firmly received in the insulation main body 2.

Figure 5:
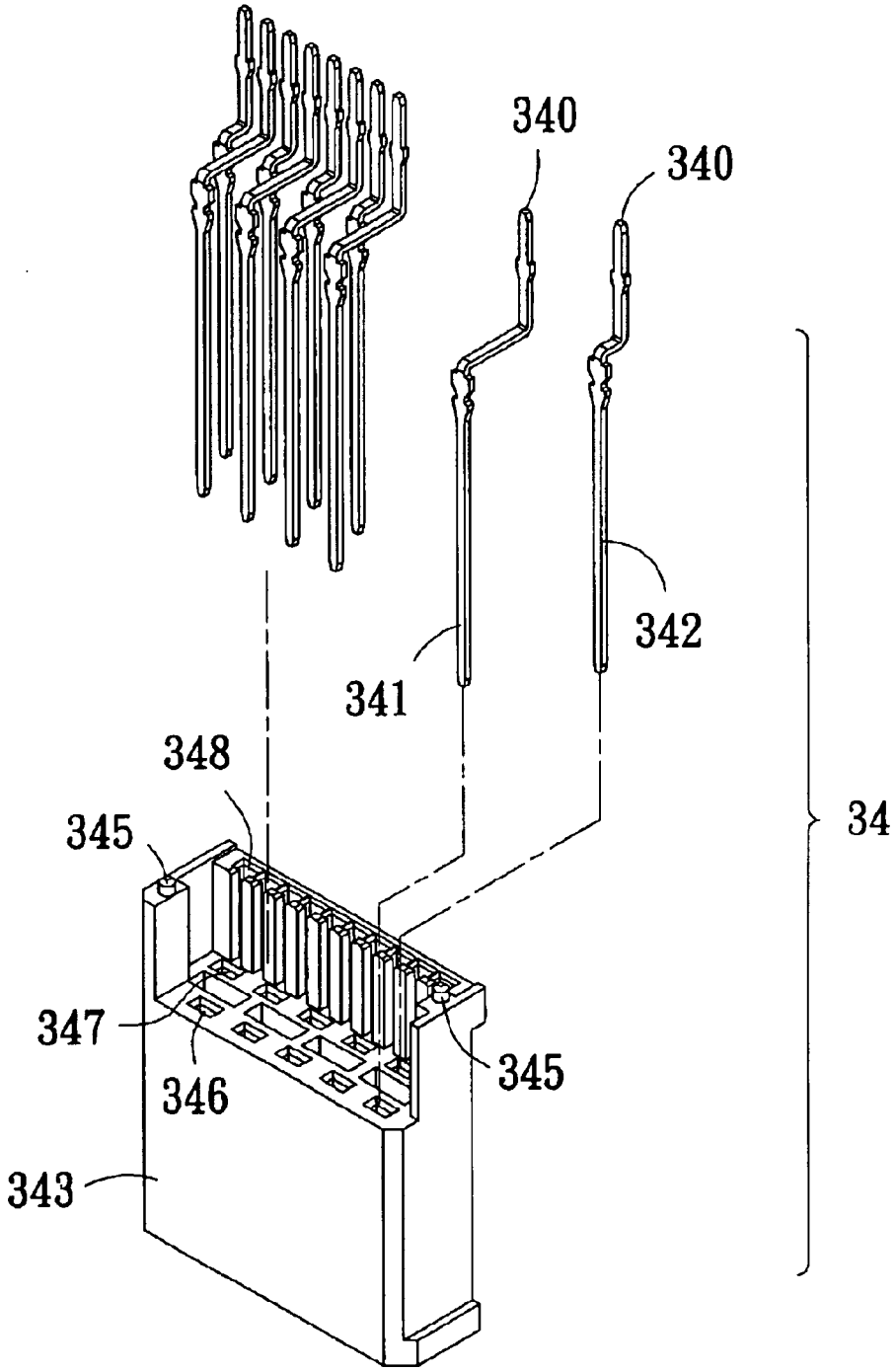
FIG. 5 is an exploded perspective view of a modular jack of the present invention.

And more, as shown in FIG. 5, in the modular jack 34, the carrier 343 has a first row of pin holes 346 for insertion therein of the long pins 341, and has a second row of pin holes 347 for insertion therein of the short pins 342. The pin ends 340 for welding of the long and short pins 341, 342 can be fixed in embedding grooves 348 and aligned in a line, so that most of the long and short pins 341, 342 of the modular jack 34 can be enveloped and fixed in the carrier 343.

Figure 6:
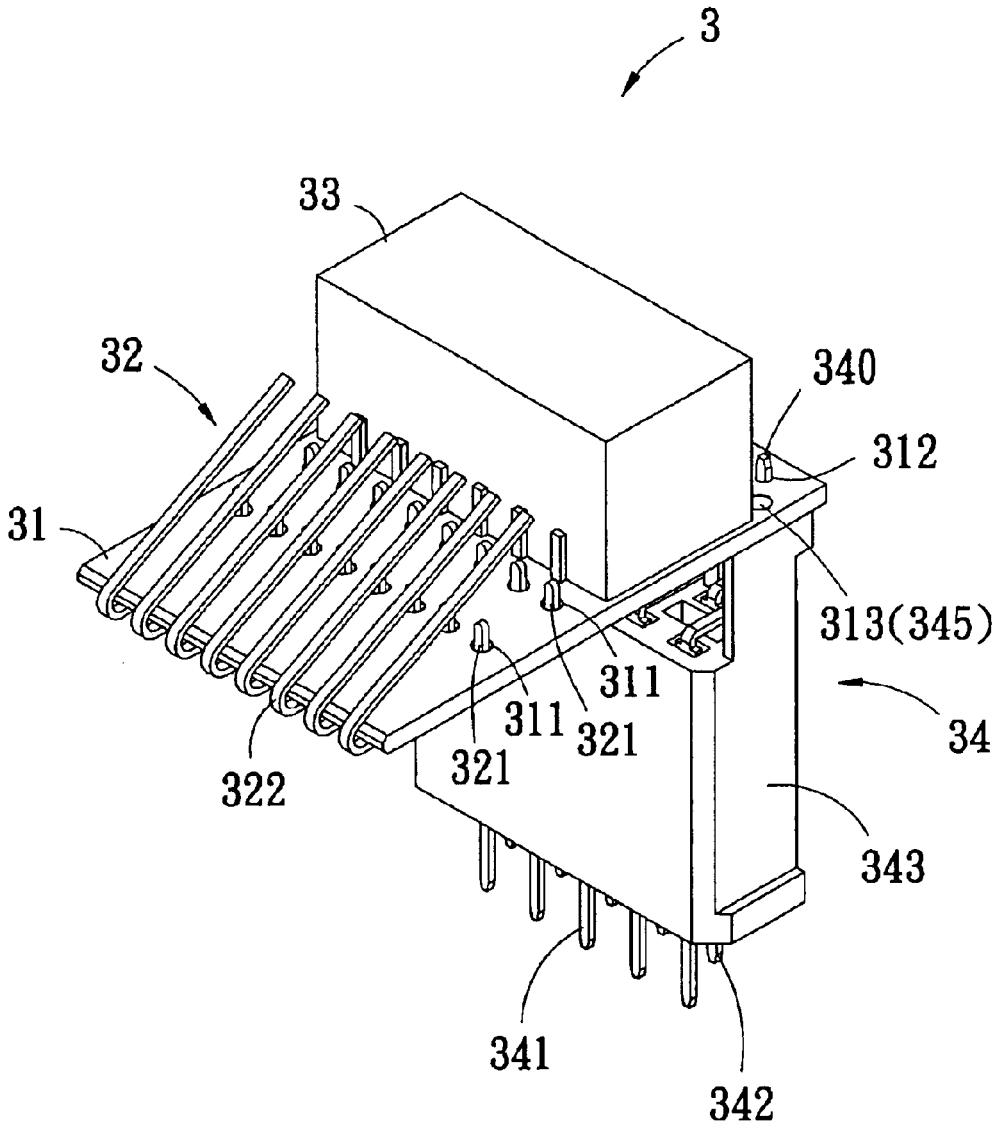
FIG. 6 is a perspective view showing the appearance of a first electric connector of the present invention after assembling.
Figure 7:
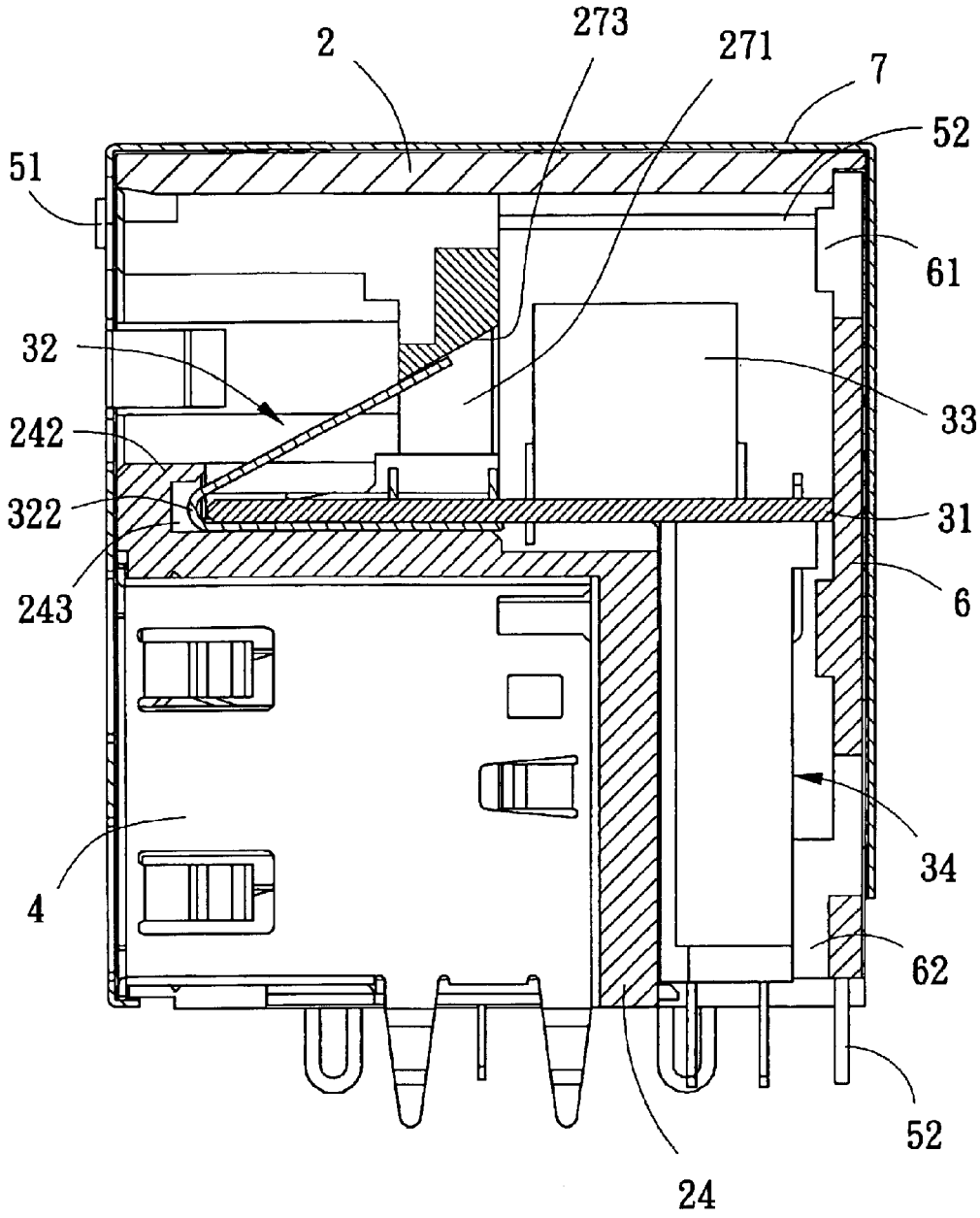
FIG. 7 is a partial sectional view taken from FIG. 1 of the present invention.

When in assembling, referring to FIGS. 3–7, the pin ends 321 for welding on one side of the electric conductive pins 32 are sequentially welded at one side of the electronic element 33 of the circuit board 31 (as shown in FIG. 6), and the modular jack 34 is welded to the other side of the electronic element 33 to form the first electric connector 3 (RJ45), then the first electric connector 3 is pushed from the location behind the insulation main body 2 into the first receiving space 25. The circuit board 31 of the first electric connector 3 is moved forward on the L-shaped partition 24 to render the circuit board 31 to be pushed into the step portion 242 with a U-shaped cross-section on an end of the partition 24, so that the bends 322 of the electric conductive pins 32 at one side of the circuit board 31 can be received in the mutually spaced receiving slits 243 forming the shape of a fence in the step portion 242. And the ends on the other side of the electric conductive pins 32 are sequentially abutted against the bevel edges 273 of the slits 271 with trapezoidal walls of the long rib member 27. So that the circuit board 31 can be flatly placed on the platforms 244, and clamped and framed by the positioning notch 274 on one end of the long rib member 27 and the step portion 242 with a U-shaped cross-section. Therefore, the first electric connector 3 can be tightly and firmly received in the first receiving space 25. Then the two signal displays 5 are pushed from the location behind the insulation main body 2 forwards to the front end of the two passages 28, and the second electric connector 4 is received in the second receiving space 26 from the front side the insulation main body 2. Lastly, the rear lid 6 is fixed on the rear side of the insulation main body 2, and the obscuring housing 7 is slipped over to envelop the insulation main body 2. Thereby the electric connector combination composed of an RJ45 and a USB electric connector is completed (as shown in FIG. 1).

Therefore, the present invention has the following advantages:

1. The present invention directly uses an insulation main body concurrently as a pin seat for the first electric connector (RJ45) and a fixing seat of the second electric connector (USB). This can reduce composing elements, and can lower the cost of mould making for the housings formed by injection molding of plastic.
2. When in assembling the first electric connector of the present invention, the tailing ends of the electric conductive pins limited in the slits with trapezoidal walls and are abutted against a plurality of bevel edges. The bends of the electric conductive pins are embedded in the receiving slits. The circuit board is inserted between the platforms and the positioning notch.
3. In the modular jack, the carrier has a first and a second row of pin holes for insertion therein of the long pins and short pins; and the pin ends for welding of the long and short pins can be fixed in the embedding grooves and aligned in a line, so that most of the long and short pins can be enveloped and fixed in the carrier.

In conclusion, the present invention surely can achieve its expected object to provide an electric connector combination with industrial value; the description above is only for illustrating a preferred embodiment of the present invention, and not for giving any limitation to the scope of the present invention. It will be apparent to those skilled in this art that various modifications or changes without departing from the spirit of this invention shall also fall within the scope of the appended claims.

Having thus described my invention, what I claim as new and desire to be secured by Letters Patent of the United States are:

1. An electric connector combination comprising: an insulation main body, a first electric connector, a second electric connector, two signal displays, a rear lid and an obscuring housing, wherein:

said insulation main body has two lateral walls and a top wall, an interior space between said two lateral walls is partitioned into a first receiving space and a second receiving space with an L-shaped partition, said partition has a step portion with a U-shaped cross-section on an end thereof, wherein the step portion has a plurality of mutually spaced receiving slits forming the shape of a fence, a long rib member is provided between said partition and said top wall, said long rib member has therein a plurality of slits with trapezoidal walls, said long rib member has positioning notches on two lateral ends thereof, and a passage extending rearwards is provided on each of junctions between said top wall and said two lateral walls;

said first electric connector is composed of a circuit board, a plurality of electric conductive pins and a modular jack, said circuit board has an electronic element thereon, said electric conductive pins are provided by welding on a front end of said circuit board and at a side of said electronic element; said modular jack is provided by welding on a rear end of said circuit board and at the other side of said electronic element; said circuit board is inserted in said two positioning notches of said long rib member of said insulation main body, while tailing ends of said electric conductive pins are limited in said slits with trapezoidal walls, said electric conductive pins have bends which are embedded in said receiving slits on said partition of said insulation main body;

said second electric connector has two USB ports able to be embedded in said second receiving space of said insulation main body;

said two signal displays are light-emitting diodes, each has a light-emitting portion; said light-emitting portions are adapted for embedding in said passages of said insulation main body;

said rear lid has positioning insertion-holes and insertion grooves on two lateral sides thereof for insertion of L-shaped pins of said signal displays; said rear lid is adapted for fixing on the rear of said insulation main body;

said obscuring housing is integrally formed of electric conductive material, being used to slip over and envelop said insulation main body.

2. The electric connector combination as in claim 1, wherein said circuit board is provided with front pin-holes on the front area thereof, said electric conductive pins have pin ends for welding to said front pin-holes of said circuit board, and said bends are bended into sharp angles.

3. The electric connector combination as in claim 2, wherein said front pin-holes on said front area of said circuit board and said pin ends of said electric conductive pins are arrayed both in plural rows.

4. The electric connector combination as in claim 1, wherein said circuit board is provided with rear pin-holes and a pair of fixing holes on a rear area thereof; said modular jack is comprised of a plurality of long pins and short pins alternately arranged on a carrier; said pin ends for welding of said long and short pins are adapted for welding fixedly to said rear pin-holes of said circuit board, and a pair of fixing posts are provided on a top surface of said carrier to be fixed on said pair of fixing holes on said circuit board.

5. The electric connector combination as in claim 4, wherein said carrier has a first row and a second row of pin holes and a plurality of embedding grooves all for insertion therein of said long and short pins, said pin ends for welding of said long and short pins are adapted for fixing in said embedding grooves and aligned in a line.

6. The electric connector combination as in claim 1, wherein two platforms are respectively disposed on the two lateral sides of the receiving slits, said circuit board is flatly placed on said platforms and is clamped and framed by said positioning notch on one end of said long rib member and said step portion with a U-shaped cross-section.

* * * * *